United States Patent [19]

Snyder et al.

[11] 4,450,976

[45] May 29, 1984

[54] WHEELED MOLDED CONTAINER WITH HINGED LID

[75] Inventors: Larry L. Snyder; Richard Florer, both of Lincoln, Nebr.

[73] Assignee: Snyder Industries, Inc., Lincoln, Nebr.

[21] Appl. No.: 350,874

[22] Filed: Feb. 22, 1982

[51] Int. Cl.[3] ..... B65D 43/14; B65D 51/04

[52] U.S. Cl. ..... 220/343; 220/1 T

[58] Field of Search ..... 220/1 T, 343; 280/47.26

[56] References Cited

U.S. PATENT DOCUMENTS 4,342,402 8/1982 Jungles ..... 220/243

4,401,312 8/1983 Parker ..... 220/1 T

*Primary Examiner*—George T. Hall

*Attorney, Agent, or Firm*—Banner, Birch, McKie & Beckett

[57] ABSTRACT

A molded container with a hinged lid in which the hinge rod is partially exposed to function as a handle. Integrally molding axle bushings in the container body can support a wheeled axle. The container is characterized by a minimum number of parts which can be quickly and easily assembled after molding.

15 Claims, 5 Drawing Figures

WHEELED MOLDED CONTAINER WITH HINGED LID

BACKGROUND OF THE INVENTION

The present invention relates generally to containers and, in particular, to a molded, wheeled container with a hinged lid. Such containers, particularly in larger sizes on the order of 90 gallons, are particularly well suited for handling refuse. These refuse containers are capable of being handled by automated equipment, such as a sideloading refuse truck having a retractable lifting clamp which grasps, lifts and inverts the container to empty its contents.

The use of large plastic refuse containers with hinged lids is common to many settings, especially commercial settings. Such containers usually have lids pivotally fastened to the body by hinges which are mechanically fastened to the body and the lid. In addition, handles are usually fastened to the lid to facilitate the raising of the lid when access to the interior of the container is desired. It is also common to have some type of wheeled support and handle mounted to the container to afford portability.

The manufacture of prior art containers of this type requires that extensive post-molding operations be carried out to mount the appropriate hardware on the container. For instance, to fasten the hinges holes must be drilled in the body and lid. The hinges are then secured to the container by means of screws or other mechanical fasteners. To fasten the handles, holes must again be drilled and the handles then secured by means of screws. Typically, one or more wheel axles are placed in the body after shaft mounting holes are bored in the bottom of the container and appropriate reinforcement is made to the container.

The requirement of extensive post-molding assembly poses serious problems. First, it requires the addition to the molded container of many separately manufactured parts. As an example, twenty-three parts are needed for the hinges and the handle of one prior art container. In another prior art container, 12 hardware parts are required for the wheel assembly. This large number of parts and the increased production time and labor required to assemble them increases cost and slows down production. Finally, the addition of so many parts weakens the molded container because of additional boring and the tendency for wear and fatigue of the molded material at mechanical connections. Thus, the finished product is less durable.

A strong need therefore exists for a molded, wheeled container with a hinged lid that requires few additional post-molding parts and little post-molding assembly.

SUMMARY OF THE INVENTION

Accordingly, it is an object of the present invention to provide a molded container which is simple in construction and easily assembled.

Another object of the invention is to provide a molded container with a hinged lid that requires few post-molding parts and little post-molding assembly.

Another object of the invention is to provide such a container wherein certain parts perform multiple functions to minimize the number of parts required.

Another object of the invention is to provide such a container having a simple wheel assembly.

Another object of the invention is to provide a container with axle bushings molded into the container before post-molding assembly.

Another object of the invention is to provide such a container wherein the rod which hinges together the lid and the body also functions as a handle.

These and other objects of the present invention are accomplished by providing a portable molded container with a hinged lid. The container has a container body with a bottom and an upstanding sidewall joined to the bottom. The bottom and the sidewall define an interior and the sidewall has an upper edge defining an opening into the interior. A lid which has a cover portion is adapted to overlie the opening. The container also has at least two transversely spaced hinge means for pivotally interconnecting the lid and the body. Each of the hinge means comprises a body hinge portion that extends laterally from the body near the upper edge of the sidewall, and a lid hinge portion that extends laterally from the lid adjacent the body hinge portion. A hinge rod extends between the hinge means and pivotally couples the body hinge portion and the lid hinge portion of each of the hinge means. The hinge rod is exposed in the region between the hinge means so that it can be grasped and function as a handle for manipulating the container.

The invention also includes a molded container having a bottom and an upstanding sidewall, with at least two upright, laterally spaced, parallel, hollow bosses extending outwardly from the sidewall near the bottom with the bosses having aligned apertures. An axle extends between the bosses and passes completely through the apertures in the bosses. At least one wheel is journalled on the axle to movably support the container.

The invention further includes a method of making a hollow, molded object adapted to receive a wheeled axle. The object may be made by fixing at least one tubular insert in the container mold before the container is formed with the ends of the insert contacting the mold wall. The mold is then charged with molding material, and the container is formed in the mold with molding material surrounding the bushing. The container is removed from the mold, whereby the bushing creates and defines an aperture that extends completely through the container. An axle can then be inserted through the bushing.

BRIEF DESCRIPTION OF THE DRAWINGS

The novel features of the invention are set out with particularity in the apended claims, but the invention will be understood more fully and clearly from the following detailed description of the invention as set forth in the accompanying drawings, in which:

DESCRIPTION OF A PREFERRED EMBODIMENT

The following description of a preferred embodiment of the invention relates to a large, rounded molded container on the order of 90 gallons in size. It is to be understood, however, that the principles of the invention are applicable to containers of any practicable size and shape.

Figure 2:
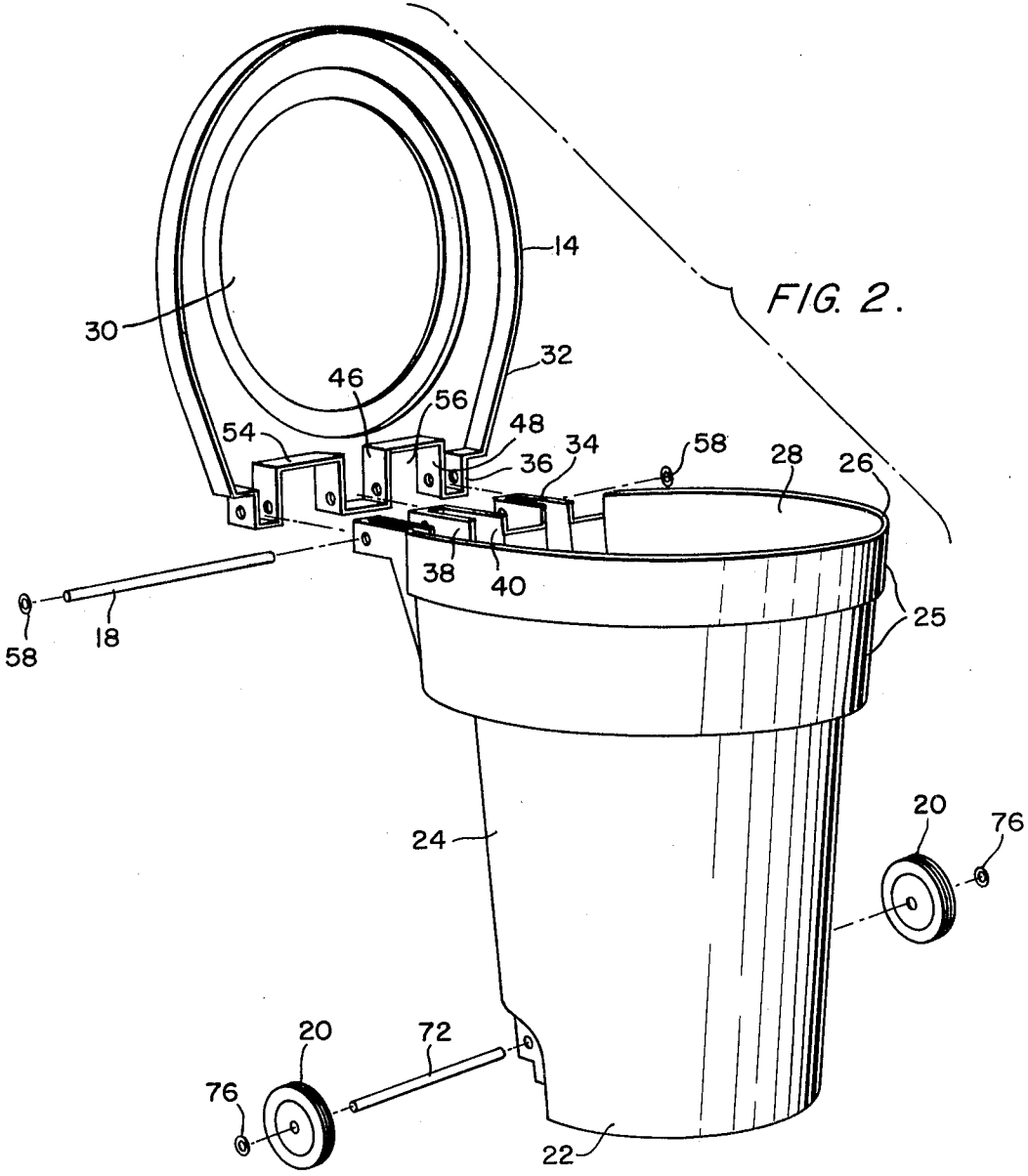
FIG. 2 is an exploded front perspective of the same.
Figure 1:
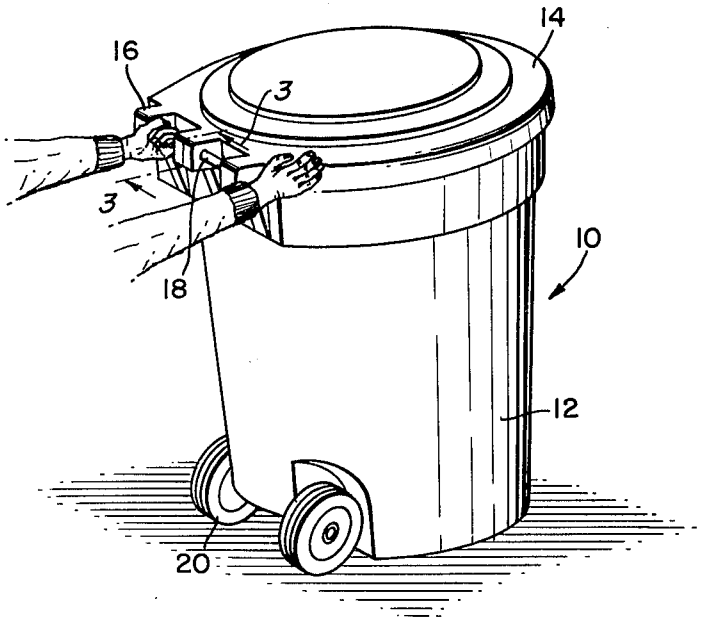
FIG. 1 is a rear perspective view illustrating the container of the present invention in use.

Referring to FIGS. 1 and 2, a molded refuse container 10 comprises a molded container body 12 and a molded lid 14 which is pivotally coupled to the container body 12 by hinges 16. A hinge rod 18 extends through the hinges 16 to pivotally couple the container body 12 and the lid 14. Wheels 20 located at the bottom portion of the container body 12 movably support container 10.

Figure 3:
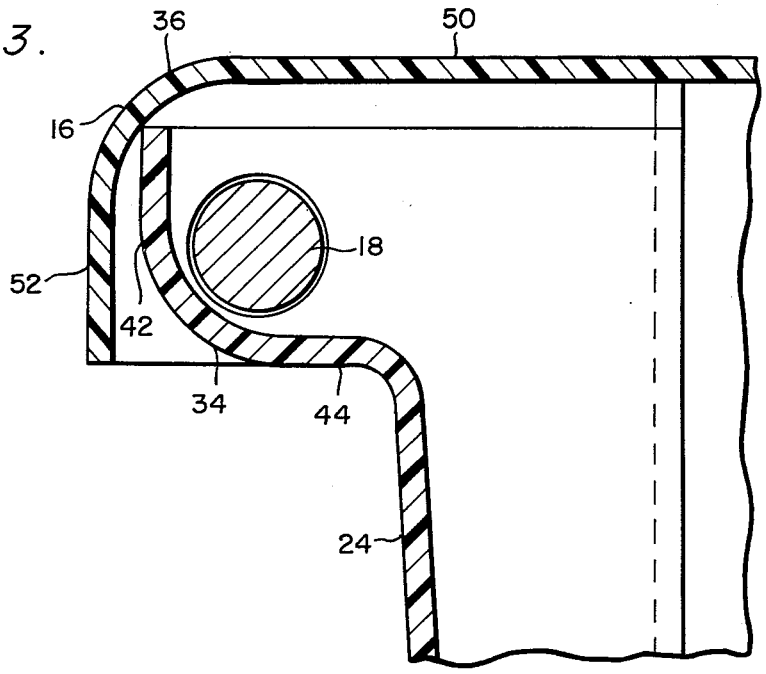
FIG. 3 is a sectional view taken along line 3—3 of FIG. 1.
Figure 4:
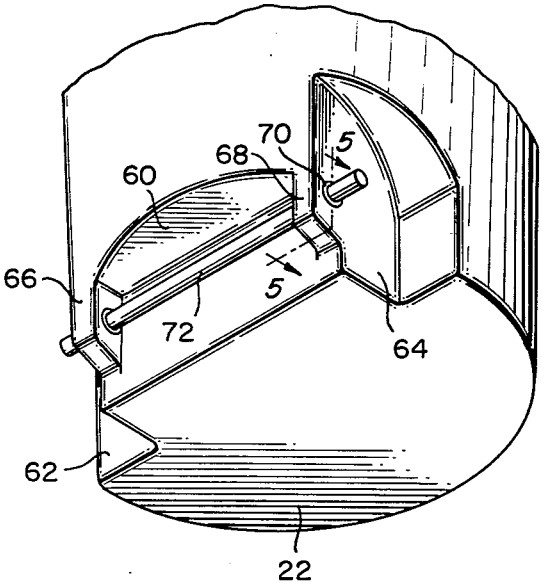
FIG. 4 is a partial rear perspective view of the same without wheels.
Figure 5:
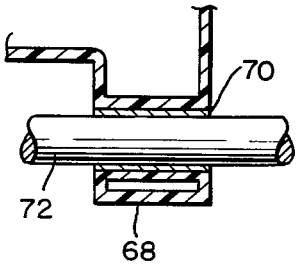
FIG. 5 is a sectional view taken along line 5—5 of FIG. 4.

Referring to FIGS. 2 and 3, container body 12 comprises a bottom 22 and a curved upstanding sidewall 24 having an enlarged upper portion 25. Sidewall 24 is joined to bottom 22 at the lower edge of body 12. The upper edge 26 of sidewall 24 defines an opening 28 into the hollow interior of container body 12.

Molded lid 14 comprises a cover portion 30 which is of sufficient size to overlie opening 28. An integrally molded depending peripheral skirt 32 is connected to cover portion 30 and surrounds the upper portion of sidewall 24 when lid 14 is closed.

Three transversely spaced hinges 16 are provided. Each hinge comprises a body hinge portion 34 and a lid hinge portion 36. Body hinge portion 34 is integrally molded with and extends laterally from body 12 near the upper edge 26 of sidewall 24. Lid hinge portion 36 is integrally molded with and extends laterally from the lid 14 adjacent body hinge portion 34.

Each body hinge portion 34 comprises a pair of transversely spaced, parallel, laterally extending flanges 38 and 40. Flanges 38 and 40 contain aligned apertures through which hinge rod 18 passes. A transverse web 42 interconnects the distal ends of flanges 38 and 40 and bottom web 44 interconnects their bottom edges. Each lid hinge portion 36 comprises two transversely spaced, parallel, laterally extending flanges 46 and 48 which also have aligned apertures through which hinge rod 18 passes. Lid hinge portion 36 also comprises a top web 50 connected to cover portion 30 and to lid hinge portion flanges 46 and 48. The distal ends of flanges 46 and 48 and top web 50 are all connected to a transverse web 52. Adjacent flanges 46 of lid hinge portions 36 are interconnected by depending skirt webs 54, while the outer flanges 46 of outer lid hinge portions 36 are joined to skirt 32. Flanges 46, 48 of lid hinge portions 36 are longer and spaced farther apart than flanges 38, 40 of body hinge portion 34. Thus, when lid 14 is closed, opening 28 is completely covered and the upper edge 26 of sidewall 24 is completely surrounded by depending portions 32, 36, 46, 48, 52 and 54 of lid 14. As seen in FIG. 3, the transition between bottom web 44 and transverse web 42 is rounded, as is the transition between top web 50 and transverse web 52. This rounding facilitates a smoother rotational joint for each of the hinges 16.

Lid flanges 46 and 48 and interconnecting depending skirt webs 54 form two regions 56 adjacent lid 14 where hinge rod 18 is exposed. As seen in FIG. 1, exposed hinge rod 18 can be grasped in either region 56 and can function as a handle for manipulating container 10. Hinge rod 18 is retained in hinges 16 by press-on cap nuts 58 located on the ends of hinge rod 16.

Referring now to FIGS. 1, 2, 4 and 5, near the bottom 22 of container body 12 there is a central depression 60 formed in sidewall 24, and two adjacent depressions 62 and 64. Depression 64 is the mirror image of depression 62 and each functions as a wheel well. Hollow bosses 66 and 68 flank the central depression 60 and are adjacent depressions 62 and 64. Bosses 66 and 68 contain axle bushings 70 which align and support wheel axle 72. Wheels 20, located on the ends of axle 72 and retained on the axle by press-on cap nuts 76, movably support the container 10.

The container is preferably manufactured by rotational molding of a high-density, cross-linkable polyolefin, preferably polyethylene. Rotational molding, known to produce objects having fairly uniform wall thickness throughout, involves the rotation of a heated mold about at least two axes, with subsequent cooling of the mold to solidify the plastic on the interior surfaces of the mold. Of course, any suitable molding method and material can be used.

Axle inserts 70 are placed in the mold before plastic is introduced into the mold, with the open ends of the inserts in contact with opposed mold walls. The plastic surrounds the inserts and forms bosses 66 and 68 around them. The vertical position of inserts 70 may be selected so that wheel wells 62 can accommodate either 8 inch or 10 inch wheels. The container body 12 and lid 14 are preferably molded as one unit, then separated after molding to form the two components. The lid, including hinge portions 36, is larger than the body portion 12 by an amount equal to or slightly greater than the wall thickness. After molding, the lid 14 and body portion 12 are severed at the upper edge 26, whereby the lid 14 can fit over the top of the container 12 and surround the upper edge 26. Aligned apertures are then bored through each of the hinge flanges 38, 40, 46, 48 and hinge rod 18 is passed through the apertures and capped. Wheel axle 72 is then passed through axle bushings 70, and the wheels 20 and cap nuts 76 are installed.

Other molding schemes may be employed. For example, the lid and the body may be molded separately. Alternatively, two bodies may be formed together top to top, in a single mold, and then severed along their common upper edge. Similarly, two lids may be formed together, skirt to skirt, and then severed along their common skirt edge.

It will be obvious to one of ordinary skill in the art that numerous modifications may be made without departing from the true spirit and scope of the invention which is to be limited only by the appended claims.

We claim:

1. A portable molded container with a hinged lid comprising:

a container body having a bottom and an upstanding sidewall joined to said bottom, said bottom and said sidewall defining a container interior, and said sidewall having an upper edge defining an opening into said interior;

a lid having a cover portion adapted to overlie said opening;

at least two transversely spaced hinge means for pivotally interconnecting said lid and said body, each of said hinge means comprising a body hinge portion extending laterally from said body near the upper edge of said sidewall, and a lid hinge portion extending laterally from said lid adjacent said body hinge portion; and a hinge rod extending between said hinge means and pivotally coupling the body hinge portion and the lid hinge portion of each of said hinge means, said hinge rod being rotatable with respect to each of said hinge portions and exposed in the region between said hinge means so that it can be grasped and function as a handle for manipulating the container.

2. A container according to claim 1 comprising three transversely spaced hinge means said hinge rod being exposed in the two regions between the center hinge means and the hinge means on either side of the center hinge means so that it can be grasped in either region and function as a handle.

3. A container according to claim 1 or 2 wherein the lid hinge portion and the body hinge portion of each of said hinge means are disposed alongside one another, and said hinge rod passes through aligned apertures in said lid hinge portions and said body hinge portions.

4. A container according to claim 3 wherein said bottom, said sidewall and said body hinge portion comprise an integrally molded structure, and said lid cover portion and said lid hinge portion comprise a separate integrally molded structure.

5. A container according to claim 4 wherein said container body, said lid and said hinge means are rotationally molded of a cross-linked, high-density polyolefin.

6. A container according to claim 3 wherein the body hinge portion and the lid hinge portion of each of said hinge means each comprises a pair of transversely spaced, parallel, laterally extending flanges having apertures through which said hinge rod passes, and a transverse web interconnecting the distal ends of said flanges, the flanges of said lid hinge portion being longer than and farther apart than the flanges of said body hinge portion so that said body hinge portion fits within said lid hinge portion.

7. A container according to claim 6 wherein the lid hinge portion of each of said hinge means comprises a top web covering the space between the flanges of said lid hinge portion, said top web being connected to the cover portion of said lid and to the flanges and to the transverse web of said lid hinge portion.

8. A container according to claim 7 wherein said bottom, said sidewall and said body hinge portion comprise an integrally molded structure, and said lid cover portion and said lid hinge portion comprise a separate integrally molded structure.

9. A container according to claim 8 wherein said container body, said lid and said hinge means are rotationally molded of a cross-linked, high-density polyolefin.

10. A container according to claim 8 wherein the cover portion of said lid is larger than said opening, and said lid further comprises a depending peripheral skirt adapted to surround the upper portion of said sidewall when the lid is closed, said skirt being joined at its ends to the outer flanges of the outer lid hinge portions.

11. A container according to claim 10 wherein said lid further comprises depending skirt webs attached to said cover portion and interconnecting adjacent flanges of said lid hinge portions in the region between said hinge means.

12. A portable molded container with a hinged lid comprising:

a container body having a bottom and an upstanding sidewall joined to said bottom, said bottom and said sidewall defining a container interior, and said sidewall having an upper edge defining an opening into said interior;

a lid having a cover portion adapted to overlie said opening;

a hinge rod;

three transversely spaced hinge means for pivotally interconnecting said lid and said body, each of said hinge means comprising a body hinge portion extending laterally from said body near the upper edge of said sidewall, and a lid hinge portion extending laterally from said lid adjacent said body hinge portion, said hinge rod extending between said hinge means and pivotally coupling the body hinge portion and the lid hinge portion of each of said hinge means;

said body hinge portion and said lid hinge portion of each of said hinge means comprising a pair of transversely spaced, parallel, laterally extending flanges having apertures through which said hinge rod passes, and a transverse web interconnecting the distal ends of said flanges, the flanges of said lid hinge portion being longer than and spaced farther apart than the flanges of said body hinge portion so that said body hinge portion fits within said lid hinge portion;

the lid portion of each of said hinge means comprising a top web covering the space between the flanges of said lid hinge portion, said top web being connected to the cover portion of said lid and to the flanges and to the transverse web of said lid hinge portion;

and said bottom, said sidewall and said body hinge portion comprise an integrally molded structure, and said lid cover portion and said lid hinge portion comprise a separate integrally molded structure.

13. A container according to claim 12 wherein the cover portion of said lid is larger than said opening, and said lid further comprises a depending peripheral skirt adapted to surround the upper portion of said sidewall when the lid is closed, said skirt being joined at its end to the outer flanges of the outer lid hinge portions.

14. A container according to claim 13 wherein said lid further comprises depending skirt webs attached to said cover portion and interconnecting adjacent flanges of said lid hinge portions in the region between said hinge means.

15. A container according to claim 12, 13 or 14, wherein said container body, said lid and said hinge means are rotationally molded of a cross-linked, high-density polyolefin.

* * * * *

UNITED STATES PATENT AND TRADEMARK OFFICE

CERTIFICATE OF CORRECTION

PATENT NO. : 4,450,976

DATED : May 29, 1984

INVENTOR(S) : Larry L. Snyder and Richard Florer

It is certified that error appears in the above-identified patent and that said Letters Patent is hereby corrected as shown below:

On the cover page, add the following to the list entitled "U.S. PATENT DOCUMENTS:"

| | | |
|---|---|---|
| 3,085,323 | 4/1963 | Handley |
| 3,292,252 | 12/1966 | Reading |
| 2,021,425 | 11/1935 | Nielsen |
| 3,354,529 | 11/1967 | James |
| 4,164,675 | 8/1979 | Sato |
| 3,224,076 | 12/1965 | Johnson |
| 4,113,398 | 9/1978 | Jordan |

Add the following beneath the above list:

FOREIGN PATENT DOCUMENTS

West Germany 2,633,553 10/1976

Signed and Sealed this

*Twenty-fifth* Day of *December 1984*

[SEAL]

*Attest:*

*Attesting Officer*

GERALD J. MOSSINGHOFF

*Commissioner of Patents and Trademarks*